US008296903B1

(12) United States Patent
Steen et al.

(10) Patent No.: US 8,296,903 B1
(45) Date of Patent: Oct. 30, 2012

(54) SIDE-LOAD WINDOW BALANCE SYSTEM AND METHODS

(75) Inventors: Travis Steen, Sioux Falls, SD (US); Chad Swier, Sioux Falls, SD (US)

(73) Assignee: Amesbury Group, Inc., Amesbury, MA (US)

( * ) Notice: Subject to any disclaimer, the term of this patent is extended or adjusted under 35 U.S.C. 154(b) by 122 days.

(21) Appl. No.: 12/872,571

(22) Filed: Aug. 31, 2010

Related U.S. Application Data

(60) Provisional application No. 61/239,522, filed on Sep. 3, 2009.

(51) Int. Cl.
*E05F 1/00* (2006.01)

(52) U.S. Cl. ..... 16/197

(58) Field of Classification Search ..... 16/197, 16/193, 196, 400, 401, 203, 205, 206; 49/322, 49/423, 430, 429, 445–447, 454, 456, 457, 49/176, 181

See application file for complete search history.

(56) References Cited

U.S. PATENT DOCUMENTS

| | | | | | |
|---|---|---|---|---|---|
| 2,987,758 | A * | 6/1961 | Osten, Sr. | ..... | 16/197 |
| 3,478,384 | A * | 11/1969 | Skolnik | ..... | 16/197 |
| 3,498,000 | A * | 3/1970 | Nobes | ..... | 49/446 |
| 3,688,441 | A * | 9/1972 | Rackard | ..... | 49/446 |
| 4,190,930 | A * | 3/1980 | Prosser | ..... | 16/197 |
| 5,231,795 | A * | 8/1993 | Westfall | ..... | 49/446 |
| 5,267,416 | A * | 12/1993 | Davis | ..... | 49/447 |
| 6,892,494 | B2 * | 5/2005 | Malek | ..... | 49/181 |
| 6,948,279 | B1 * | 9/2005 | Newton et al. | ..... | 49/446 |
| 7,036,275 | B2 * | 5/2006 | Quesada | ..... | 49/446 |
| 2004/0065016 | A1 * | 4/2004 | Malek | ..... | 49/181 |
| 2005/0166461 | A1 * | 8/2005 | Lucci | ..... | 49/446 |
| 2010/0077563 | A1 * | 4/2010 | Kellum, III | ..... | 16/193 |

* cited by examiner

*Primary Examiner* — Chuck Y. Mah
(74) *Attorney, Agent, or Firm* — Goodwin Procter LLP

(57) ABSTRACT

A system and method for supporting and operating a heavy window sash includes a spring assembly, a balance guide connected to the spring assembly, and a sash clip adapted to mate with the balance guide, wherein the sash clip and balance guide have mating guide surfaces and retention elements so that the sash clip is received in a fixed position relative to the balance guide when installed.

21 Claims, 9 Drawing Sheets

SIDE-LOAD WINDOW BALANCE SYSTEM AND METHODS

CROSS-REFERENCE TO RELATED APPLICATION

This application claims priority to and the benefit of U.S. Provisional Patent Application Ser. No. 61/239,522, filed on Sep. 3, 2009, the disclosure of which is hereby incorporated herein by reference in its entirety.

FIELD OF THE INVENTION

This invention relates generally to a window balance system for supporting heavy sashes.

BACKGROUND

Removing and installing a heavy sash from a window is a two-person job, because the sash can weigh up to 90 pounds or more, as often occurs in schools, offices, and commercial and institutional buildings. The counterbalance systems for such heavy sashes provide correspondingly large forces. Locking the balance shoes in place to the window frames against the strong counterbalancing forces requires more strength and security than is offered by shoe locking systems intended for smaller residential window sashes.

When a smaller residential sash is removed from a window, it can be tilted from its vertical operating plane, and this transfers part of the sash weight from the support shoes to the person holding the sash. This is undesirable when the sash is especially heavy, because a person tilting a heavy sash might find he has encountered more weight than he can handle safely. Also, shoes that accommodate sash tilting are generally more complex than shoes for a sash that remains vertical.

Current solutions utilizing balance systems for removing and installing a heavy sash are described, for example, in U.S. Pat. No. 5,231,795, U.S. Pat. No. 6,892,494, and U.S. Pat. No. 6,948,279, the disclosures of which are hereby incorporated by reference herein in their entireties. Current balance systems for supporting and operating a heavy sash require large, multi-component structures that are expensive and complex to manufacture. Further, these systems are difficult to engage and disengage from window jambs as a whole and oftentimes from each individual component. In certain instances, when some of the components are engaged to one another, the components are not efficiently and securely attached. Significant play results between elements when engaged, which decreases the reliability and security of the balance system when installed and increases wear. For example, current balance systems engage a movable arm of a sash attachment to a carrier of a shoe counterbalance. Even when engaged, the arm of the sash attachment can move within a restricted area. Moreover, certain movements or jostling of the balance system, including the shoe or sash, may disengage certain components from one another.

Further, when the balance system and sash are installed, adjustment of the balance or spring component is not possible. The adjustment mechanism of the balance or spring component is obstructed by the large, multi-component balance system. Additionally, the size of the components limits the number of applications or jamb sizes into which the balance systems can fit. Current systems utilize, for example, large shoes with protruding carrier ledges to engage with pivoting arms mounted to the sashes. This configuration can only fit into jambs with sufficiently large sash-to-jamb spacing.

Accordingly, a balance system is needed that allows for a high-weight capacity balance with a low build-up rate. Locking the support shoes of the counterbalance system within the jambs should be secure and reliable, because of the large spring forces involved. Also, the sash support should make a heavy sash easy to raise and lower, and removal and replacement of the sash should be convenient and safe. Besides these requirements, an effective window system should reliably accomplish all the necessary balance functions, with elements that are inexpensive to manufacture and easy to install and maintain.

SUMMARY OF THE INVENTION

In general, in one aspect, the invention relates to a side-load window balance system that includes a spring assembly, a balance guide connected to the spring assembly, and a sash clip adapted to mate with the balance guide. The sash clip and balance guide include mating guide surfaces and retention elements so that the sash clip can be received in a fixed position relative to the balance guide when installed. Embodiments of this aspect can include the following features. The spring assembly can include a spring mechanism 114, and the spring mechanism 114 can be a torsion spring, an extension spring, a block and tackle arrangement, a constant force balance, or any combination thereof. The balance guide can be pivotably and directly attached about a lower end of the spring assembly. The balance guide can also pivot and rotate along a transverse axis of the spring assembly. A bottom end of the spring assembly can be directly attached to an interior of the balance guide so that a portion of the balance guide overlaps a portion of the spring assembly. The retention elements of the balance guide can releasably receive the retention elements of the sash clip.

In additional embodiments of the foregoing aspect, the balance guide can form a generally U-shaped interior and include a top surface, a front surface, and two opposing side surfaces. The top surface of the balance guide can define a generally V-shaped configuration forming the mating guide surface with the retention elements of the balance guide located at a vertex of the generally V-shaped configuration to guide into alignment the retention elements to engage the sash clip with the balance guide. The top surface of the balance guide can at least partially include a front decline, a middle decline, and a rear decline together forming substantially a V-shaped configuration. A vertex of the V-shaped configuration is disposed at an internal end of the top surface. The middle decline forms a vertical slope. The front decline, the middle decline, and the rear decline align and guide the mating retention surfaces of the sash clip to the fixed position with the balance guide. The retention elements of the balance guide can be disposed adjacent the two opposing sides.

In other embodiments of the foregoing aspect, each of the two opposing side surfaces can include at least two lateral projections for engaging a window jamb and centering the balance guide in the window jamb. The retention elements of the sash clip and the balance guide can form a snap-fit engagement therebetween. The sash clip can be aligned generally horizontally to a lower end of the spring assembly when in the fixed position. The sash clip can include a unitary, substantially rigid structure forming a base surface with two arms extending from the base surface. The base surface includes means for attaching the sash clip to a window sash. The arms form a top surface and a bottom surface, the bottom surface of each of the two arms forming the mating guide surface of the sash clip. The retention elements of the sash clip can include a protrusion at a distal end of each of the two arms. In one embodiment, only the mating guide surfaces and retention elements on the arms of the sash clip contact the balance guide when the sash slip is in the fixed position relative to the balance guide.

In still other embodiments of the foregoing aspect, the invention can further include a jamb hook pivotably attached within an interior of a bottom of the balance guide, such that the jamb hook includes a lever arm and an angled hook at a distal end. Also, the lever arm can have a generally U-shaped configuration. Moreover, the jamb hook can be pivotable about an axis between a locked position and an unlocked position. The angled hook is engageable with a recess of a window jamb when in the locked position. The jamb hook is substantially disposed and releasably affixed within the interior of the balance guide when in the unlocked or stored position. Additionally, a surface of the interior of the balance guide can include a projection for securing the jamb hook at least partially within the interior of the balance guide. In yet another embodiment, the invention can further include an adjustable element coupled to a lower end of the spring assembly to adjust spring tension. The adjustable element can be exposed and accessible through the balance guide when installed. In a further embodiment, the invention can include one or more additional spring assemblies connected to the balance guide.

In another aspect, the invention relates to a balance guide for a side-load window balance system including a generally U-shaped structure having a top surface, a front surface, and two opposing side surfaces, the top surface defining a generally V-shaped configuration with at least one retention element located at a vertex of the generally V-shaped configuration to guide into alignment corresponding retention elements of a sash clip to secure the sash clip with the balance guide. Embodiments of this aspect can include the following features. The generally V-shaped configuration can include a first decline disposed on a front portion of the top surface terminating at an internal end of the top surface, a second decline disposed on a rear portion of the top surface terminating at an internal end of the top surface, and a third decline on the top surface forming a vertical edge between the first decline and the second decline, such that the first decline, the second decline, and the third decline form a generally V-shaped configuration. A vertex of the V-shape can be a retention surface for engaging a sash clip. The two opposing side surfaces can include a plurality of projections extending therefrom for engaging a window jamb and centering the balance guide in the window jamb. The retention elements can include recesses or apertures for releasably receiving corresponding retention elements of a sash clip. The recesses or apertures can have a bulbous shape. In one embodiment, the invention can further include a jamb hook pivotably attached within an interior of the balance guide, such that the jamb hook includes a lever arm and an angled hook disposed at a distal end of the lever arm. The lever arm can define a generally U-shaped configuration. The jamb hook can be pivotable about an axis between a locked position and an unlocked position. The angled hook is engageable with a recess of a window jamb when in the locked position. The jamb hook is substantially disposed and releasably affixed within the interior of the balance guide when in the unlocked or stored position. A surface of the interior of the balance guide can include a projection for securing the jamb hook at least partially within the interior of the balance guide. The projection can be a slight protuberance or a ramp for a slight interference fit to prevent inadvertent pivoting of the jamb hook when in the unlocked and stored position.

In still another aspect, the invention relates to a sash clip for a side-load window balance system including a unitary, substantially rigid structure having a base surface and two arms extending from the base surface. Each arm has a top surface and a bottom surface. The bottom surface forms an angled surface and a protrusion at a distal end of the angled surface is configured for mating with a balance guide. In one embodiment, the base surface includes means for attaching the sash clip to a window sash.

In yet another aspect, the invention provides a method of installing a side-load window balance system. The method includes the steps of mounting a spring assembly to a window jamb, the spring assembly including a balance guide at a lower end, extending the spring assembly to lower the balance guide, securing the balance guide to the window jamb, installing a sash having a mating sash clip mounted thereto, lowering the sash so that mating guide surfaces and retention elements of the sash clip and the balance guide align so that the sash clip can be received in a fixed position relative to the balance guide when installed, and releasing the balance guide from the window jamb.

The securing step can include pivoting a jamb hook coupled to the balance guide into engagement with a recess or other feature of the jamb. The releasing step can include disengaging the jamb hook from the jamb. In another embodiment, the step of extending the spring assembly can include engaging an extender tool assembly to the balance guide, the extender tool assembly having a second mating sash clip mounted thereto. The second mating sash clip forms mating guide surfaces and retention elements to mate with corresponding mating guide surfaces and retention elements of the balance guide, so that the second mating sash clip can be received in a fixed position relative to the balance guide. The step of extending the spring assembly can also include using the extender tool assembly to lower and extend the spring assembly, whereby the extender tool assembly can be then removed from the balance guide after the step of securing the balance guide to the window jamb.

In another aspect, the invention relates to a tool for installing a side-load window balance system. The tool includes a handle, a sash clip disposed at one end of the handle, and a guide shield disposed between the sash clip and the handle. The sash clip includes mating guide surfaces and retention elements so that the sash clip engages a mating balance guide. The guide shield can substantially encompass and extend beyond the sash clip. The guide shield is configured to maintain the sash clip in a fixed position relative to the balance guide. In one embodiment, the handle is cylindrical. The guide shield can include a generally U-shaped structure.

The counterbalance side-load window balance system for a sash described herein is laterally removable from between opposed window jambs by utilizing, at least, a sash clip for transferring the weight of the sash to a balance guide. The sash can be lifted off of the counterbalance support balance guide and laterally removed from between the window jambs and conversely reinserted between window jambs and lowered onto the balance guide. This is done while the balance guide is in the locked position within the window jambs.

The counterbalance balance guides, which are biased upwardly by counterbalance springs, such as hybrid springs, cooperate and are engageable with the sash clip. The balance guides receive and support the sash weight transferred to the balance guides by the sash clip. The balance guides can be reliably secured in the jambs by engaging apertures or recesses or other features formed in the jambs for this purpose.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE FIGURES

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1:
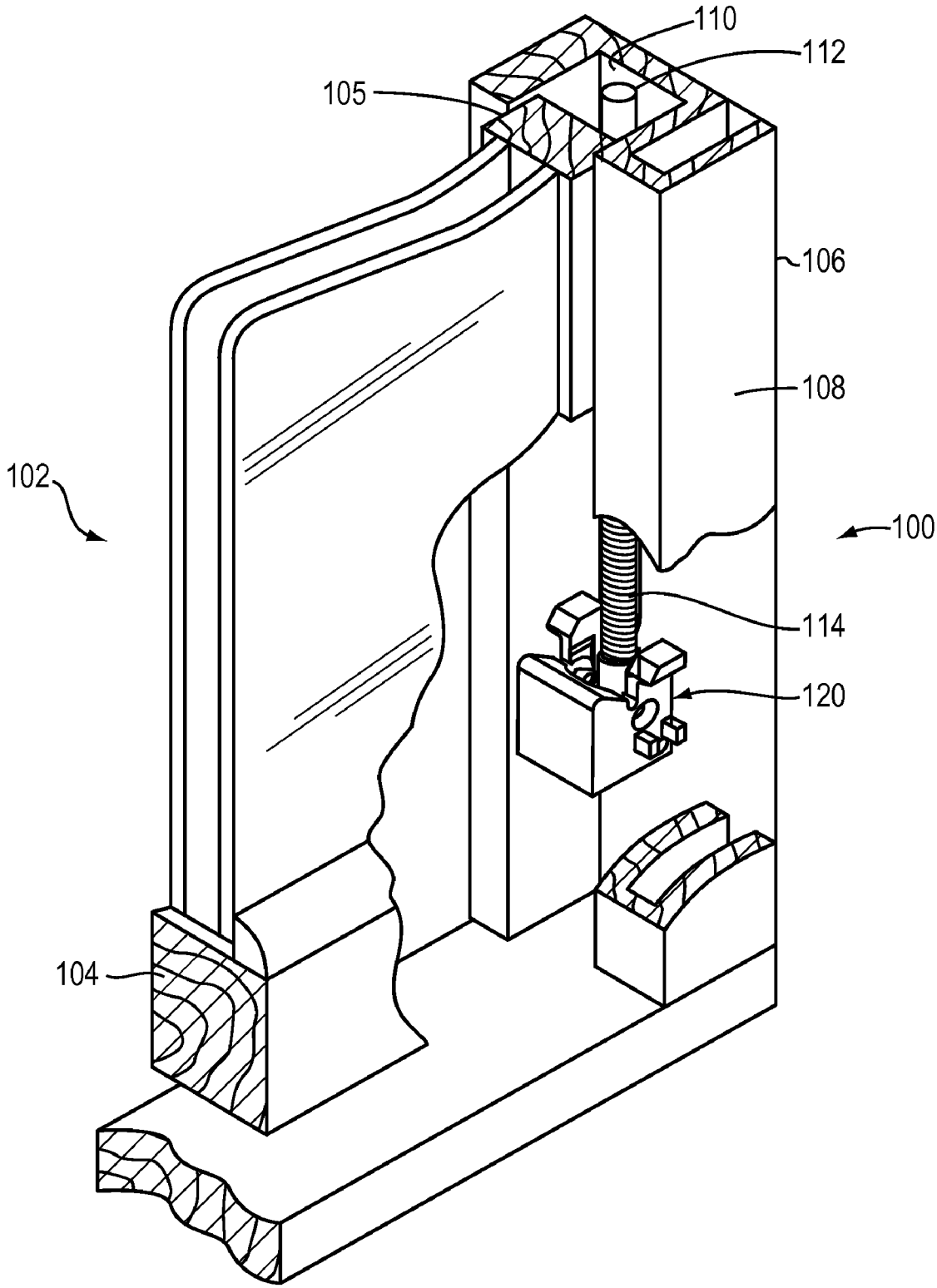
FIG. 1 is a partial cutaway schematic perspective view of a window assembly and a side-load window balance system in accordance with one embodiment of the invention.

FIG. 1 is a cutaway view of a portion of a window assembly 100. The window assembly 100 includes a window sash 102 having a lower rail 104 and a vertical stile 105, a frame 106, and a side member 108 of the frame 106. The frame 106 forms multiple jamb channels 110, one of which is shown in FIG. 1, along the side member 108 of the frame 106. The jamb channel 110 retains the vertical stile 105 of the window sash 102. A balance tube 112 is disposed and secured within the jamb channel 110, typically at an upper end thereof. The balance tube 112 at least partially houses and is coupled to a spring mechanism 114. The balance tube 112 and the spring mechanism 114 are generally referred to as a spring assembly. A generally U-shaped balance guide 120 is directly coupled and pivotably attached to a lower end of the spring mechanism 114. While only one side of the window assembly 100 is depicted, it will be understood that a symmetrical balance system is provided in the opposite jamb channel. Additional sash are similarly mounted and balanced, for example in a double hung window.

Figure 2:
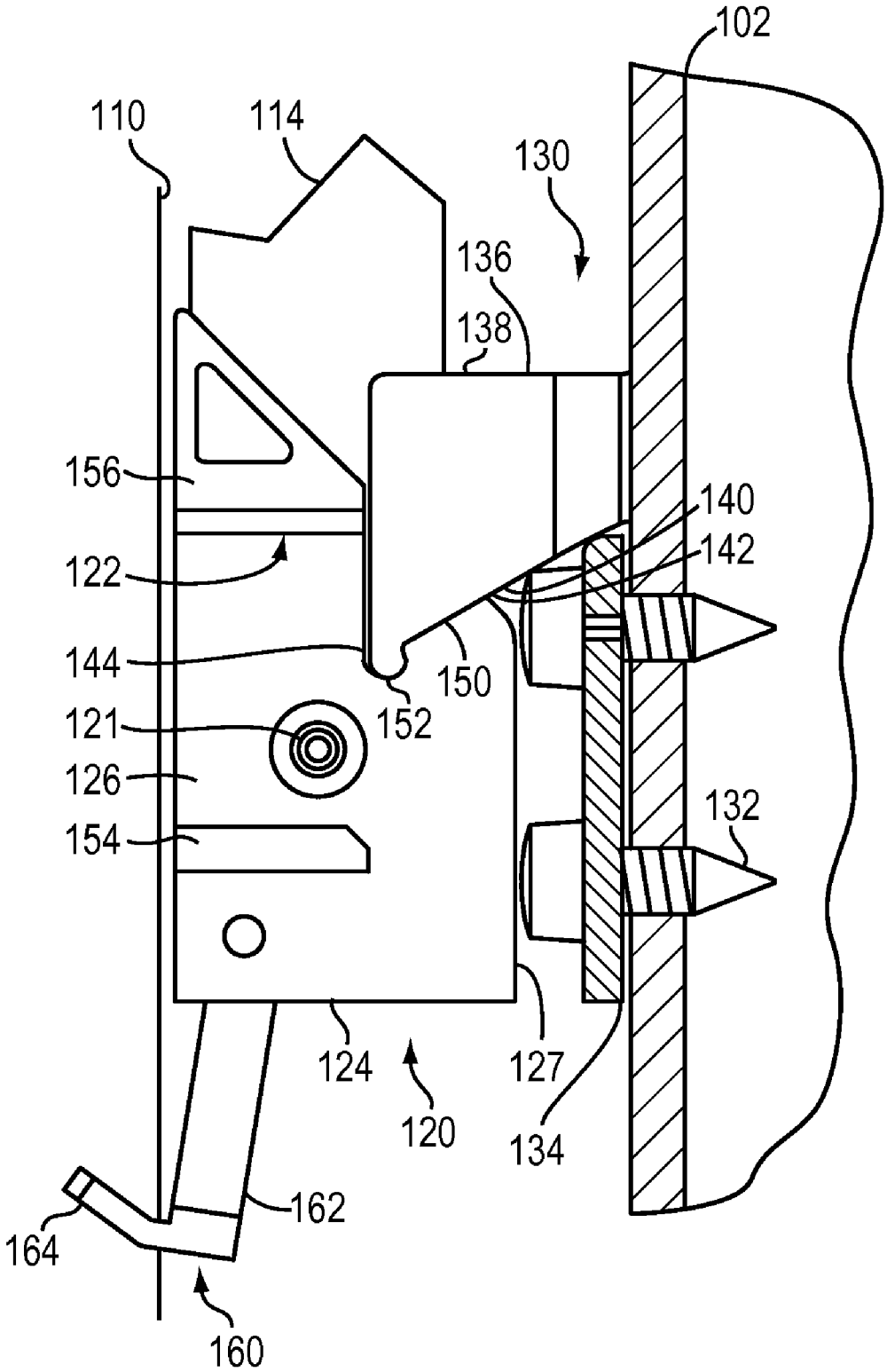
FIG. 2 is a schematic partial cross-section side view of a window assembly and a side-load window balance system in accordance with an embodiment of the invention.

FIG. 2 is a cutaway, magnified side view of a portion of a side-load window balance system attached to the sash 102 via a sash clip 130. The balance guide 120, which is directly coupled to the spring assembly, for example by a pivot pin 121, is engaged within the jamb channel 110 via a jamb hook 160 to permit installation and removal of the sash 102. The sash clip 130, which is attached to the sash 102, is engaged with the balance guide 120. Alternatively, the sash clip 130 can be attached to various parts of the window sash 102, for example, the lower rail 104, the vertical stile 105, or a combination thereof. The balance guide 120 is discussed further hereinbelow with respect to FIG. 3. The jamb hook 160, which is disposed within an interior of the balance guide 120, is discussed further hereinbelow with respect to FIG. 9. The sash clip 130, which engages the balance guide 120, is discussed further hereinbelow with respect to FIG. 16. The operation and interaction of the various components are described in detail after the description of the various components.

Figure 3:
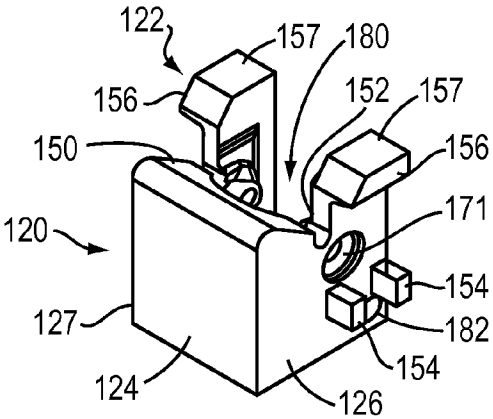
FIG. 3 is a schematic perspective view of a balance guide in accordance with one embodiment of the invention.

FIGS. 3-8 depict various views of the generally U-shaped balance guide 120. The balance guide 120 defines an interior cavity 180 and may be made of plastic, die cast metal, composite, etc. In FIG. 3, an embodiment of the balance guide 120 is shown without attachment to the spring mechanism 114. The balance guide 120 includes a top surface 122, a bottom surface 124, a front side 127, and two opposing sides 126. The top surface 122 of the balance guide 120 forms mating guide surfaces 150, 157, 158 and retention elements 152. The mating guide surfaces 150, 157, 158 of the balance guide 120 include a generally V-shaped configuration with the retention elements 152 located at a vertex thereof. In one embodiment, at least one of the mating guide surfaces 150, 157, 158 of the balance guide 120 is a portion of the top surface 122 partially forming a decline 150 with at least one recess or aperture 152 (i.e., the retention element) disposed at an internal end of the decline 150. The recess 152 may have various linear or arcuate shapes, for example, a semi-circle, a bulbous recess, an oblong shape, a triangle, a rectangle, and a square. A connection aperture 171 is formed in the two opposing sides 126 of the balance guide 120 for receiving a pin, rivet, or other means for connection to the spring mechanism 114.

The two opposing sides 126 of the balance guide 120 include a plurality of projections 154, 156 extending therefrom. A first projection 156 is disposed at a height higher than the decline 150 of the top surface 122 of the balance guide 120. The top surface of this projection 156 (i.e., a mating guide surface), which can be a second top surface of the balance guide 120, partially slopes downward while the remaining surface is substantially horizontal. In an alternative embodiment, the entire top surface of projection 156 slopes downwards.

Figure 7:
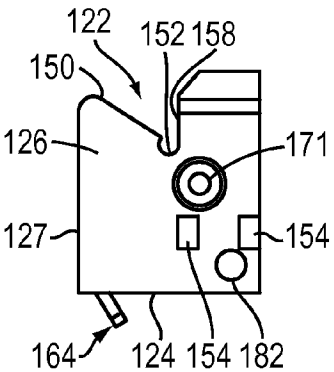
FIG. 7 is a schematic side view of the balance guide of FIG. 3.

In this embodiment of the balance guide 120, each of the projections 154, 156 on the opposing sides 126 of the balance guide 120 project a substantially equal distance away from the sides 126. The total width of the balance guide 120 with projections 154, 156 may have a dimension substantially equal to, but slightly less than the width of the jamb channel 110. In this manner, the projections 154, 156 can align and center the balance guide 120 and, accordingly, the sash 102 within the jamb channel 110. In an alternative embodiment, the total width of the projections 154, 156 on both sides 126 of the balance guide 120 may generally terminate at the sides of the jamb channel 110 to provide a sliding surface minimizing play between the projections 154, 156 in the jamb channel 110. Shown in FIG. 7 are three projections 154, 156 on one of the opposing sides 126 of the balance guide 120. More or less projections can be used to suit a particular application. These projections 154, 156 may be used at various points along the side 126 in order to provide varying or additional points of stability to align and center the balance guide within the jamb channel 110. In an alternative embodiment, the projections 154, 156 are located anywhere on the two opposing sides 126 aft of the recesses 152.

Figure 4:
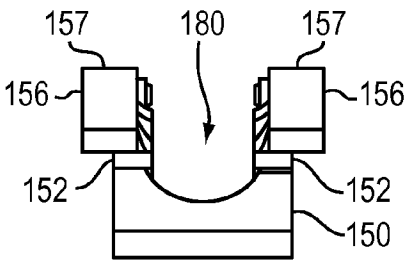
FIG. 4 is a schematic top view of the balance guide of FIG. 3.

FIG. 4 depicts a top view of the balance guide 120. In one embodiment, the balance guide 120 defines a generally U-shaped interior cavity 180. Also, the recesses 152 may be formed anywhere on the top surface 122 of the balance guide 120. For example, the recesses 152 may be formed at a midpoint or substantially near a midpoint in the balance guide 120. The recesses 152 may also be formed internally, within the guide 120 and adjacent the two opposing sides 126 of the balance guide 120, to provide positive front-to-back and side-to-side alignment with the sash clip 130.

Figure 6:
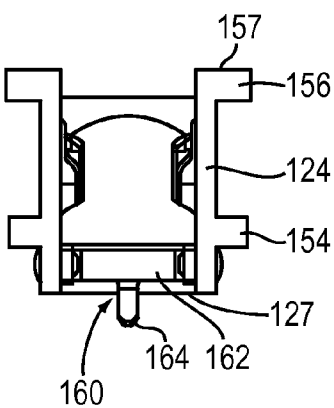
FIG. 6 is a schematic rear view of the balance guide of FIG. 3.
Figure 5:
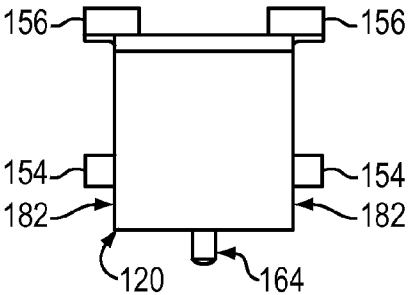
FIG. 5 is a schematic front view of the balance guide of FIG. 3.
Figure 8:
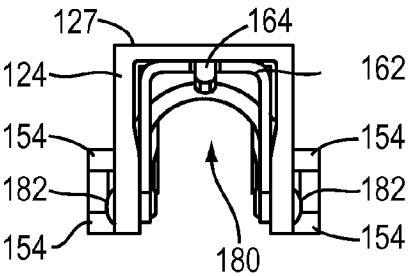
FIG. 8 is a schematic bottom view of the balance guide of FIG. 3.

FIG. 5 depicts a front view of the balance guide 120 partially showing a portion of the jamb hook 160. The jamb hook 160 may be pivotably affixed to the interior cavity 180 of the balance guide 120 via pins rivets 182 or other fastening means. FIG. 6 depicts a rear view of the balance guide 120 showing the jamb hook 160 in greater detail. The jamb hook 160 includes a lever arm 162 and an angled hook 164 extending from a central portion of the lever arm 162. In one embodiment, the angled hook 164 is configured to engage an opening in the jamb channel 110. The jamb hook 160 pivots about an axis between a first position and a second position. In the first position, such as a locked position, the angled hook 164 of the jamb hook 160 is positioned to engage the jamb channel 110. In a second position, such as an unlocked or stored position, the jamb hook 160 is substantially disposed within the interior cavity 180 of the balance guide 120, as shown in FIGS. 6-7. In this embodiment, the width of the lever arm 162 of the jamb hook 160 is substantially equal to the width of the interior of the balance guide 120 to provide a friction fit when the jamb hook 160 is in the second position. In an alternative embodiment, a small projection, such as a notch, protuberance, or a ramp, can be formed in the interior cavity 180 near the bottom surface 126 of the front side 127 of the balance guide 120. The small projection may provide a further friction fit or slight interference fit to maintain the jamb hook 160 in the second position when not being used to engage the jamb channel 110. In another embodiment, the lever arm 162 is of a length such that the distal end of the lever arm 162 does not contact the interior of the front side 127 of the balance guide when the jamb hook 160 is in the second position.

FIG. 7 depicts a side view of the balance guide 120. As discussed hereinabove, the top surface 122 of the balance guide partially forms the decline 150 and at least one recess 152 disposed at an internal end thereof. The top surface 122 also includes the vertical edge 158 (i.e., mating guide surface 158). The angle of the decline 150 may be about parallel to about perpendicular with respect to the vertical edge 158. For example, the decline 150 may be formed at an angle of about 30 degrees to about 75 degrees with respect to the vertical edge 158. In one embodiment, the decline 150 is formed at an angle of about 60 degrees away from vertical edge 158.

Figure 9:
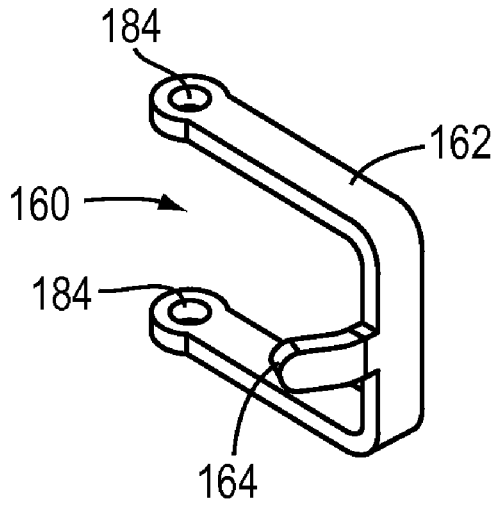
FIG. 9 is a schematic perspective view of a jamb hook in accordance with one embodiment of the invention.
Figure 10:
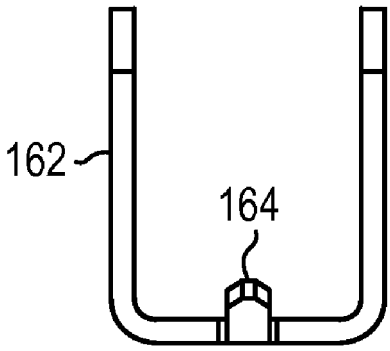
FIG. 10 is a schematic rear view of the jamb hook of FIG. 9.
Figure 11:
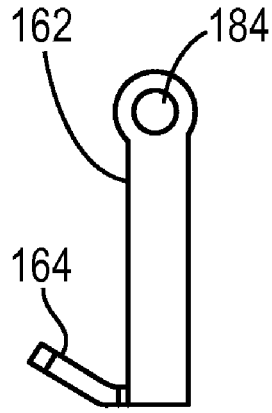
FIG. 11 is a schematic side view of the jamb hook of FIG. 9.

As shown in FIGS. 9-11, the jamb hook 160 can be manufactured as a separate structure from the balance guide 120. The jamb hook 160 may be made of plastic, steel, or composite. The jamb hook 160 can be directly attached to the interior of the balance 120 guide via rivets 182 or other mechanical fastening means and connected via apertures 184 in the lever arm 162. In the embodiment shown, the angled hook 164 is integrally formed with the lever arm 162. In an alternative embodiment, the angled hook 162 is a separate structure that is affixed to the lever arm 162, for example, via epoxy, welding, or other attachment means. The lever arm 162 may have a generally U-shaped configuration. Other configurations are also contemplated. The angled hook 164 may be formed at an angle between about perpendicular to the lever arm 162 and about parallel to the lever arm 162. For example, the angled hook 164 may be formed at an angle of about 15 degrees to about 75 degrees with respect to the lever arm 162.

Figure 12:
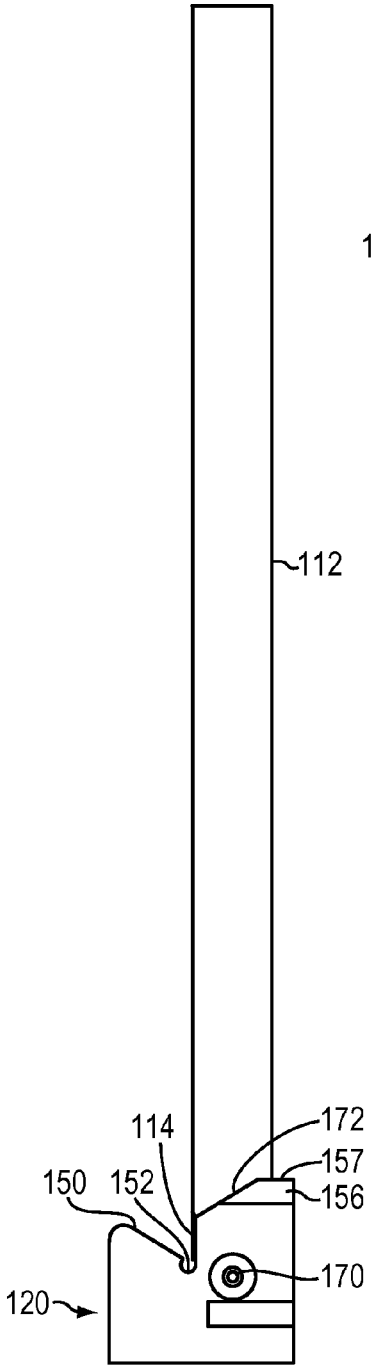
FIG. 12 is a schematic side view of a window balance and a balance guide in accordance with one embodiment of the invention.

FIG. 12 depicts a side view of a balance tube 112 and a balance guide 120 in accordance with one embodiment of the invention. The balance guide 120 is directly and rigidly attached to a spring mechanism 114 (only partially shown) disposed in the tube 112 at a connection point 170. The connection point 170 allows the balance guide 120 to rotate about a transverse axis with respect to the balance tube 112 and the spring mechanism 114. The spring mechanism 114 is at least partially disposed within the balance tube 112. The spring mechanism 114 may be a torsion spring, an extension spring, a hybrid spring such as a torsion spring and an extension spring, a block and tackle arrangement, a constant force balance, or combinations thereof. An alternative embodiment of the balance guide 120 is shown that includes a first portion of the top surface that partially forms a decline 150 with recesses 152 at an internal end thereof and a second top surface 157 (i.e., mating guide surface) having a decline 172 that at least partially slopes downward toward the recesses 152.

Figure 13:
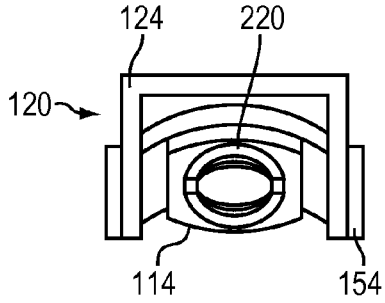
FIG. 13 is a schematic bottom view of the window balance and the balance guide of FIG. 12.

FIG. 13 depicts a bottom view of the balance tube 112, the spring mechanism 114, and the balance guide 120 (i.e., the balance assembly). At this end of the balance assembly, the spring mechanism 114 at least partially houses and is coupled to an adjustment element 220. The adjustment element 220 is exposed and accessible at least through the bottom surface 124 of the balance guide 120. The adjustment element 220 may be a screw, which can be manually adjusted or manipulated with a screwdriver to vary the tension and force of the spring mechanism 114.

Figure 14:
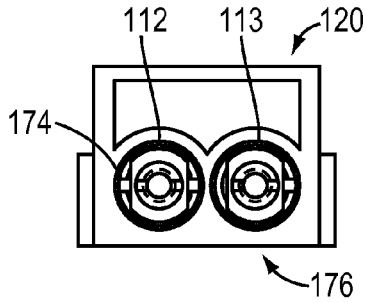
FIG. 14 is a schematic top view of a window balance and balance guide in accordance with one embodiment of the invention.
Figure 15:
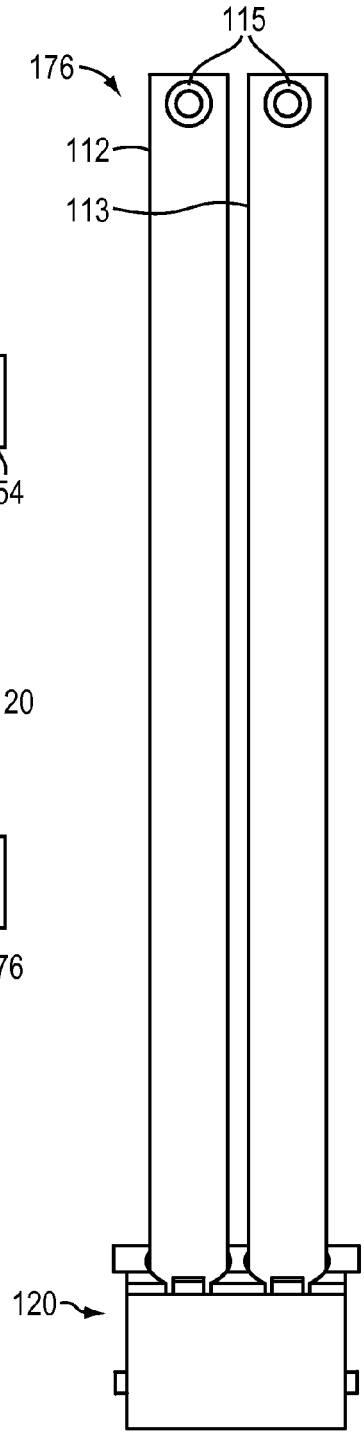
FIG. 15 is a schematic front view of the window balance and the balance guide of FIG. 14.

FIGS. 14-15 depict views of an alternative embodiment of the balance assembly including two balance tubes and two spring mechanisms. Two balance tubes 112, 113 with respective spring mechanisms 114 may be used, for example, in order to provide additional spring or balance force to support a heavier window sash. The spring mechanisms 114 are at least partially disposed within the balance tubes 112, 113. The spring mechanisms 114 are attached to a bar 174 disposed transversely in an interior of a distal end 176 of the balance tubes 112, 113. Alternatively, the spring mechanisms are looped about the bar 174 or integrally formed with the bar 174. Included at the distal end 176 of the balance tubes 112, 113 are mounting means 115 to mount the balance tubes 112, 113 to a jamb channel. The mounting means 115 can be a bushing or other structural element, to permit the upper portion of the balance tubes 112, 113 to be screwed, bolted, or otherwise affixed to the window frame 106. The other ends of the spring mechanisms 114 terminate outside of the balance tubes 112, 113 and are disposed at least partially within the cavity of the balance guide 120 via a direct attachment at the connection point 170. FIG. 15 depicts a front view of the balance tubes 112, 113 and the balance guide 120 of FIG. 14. The balance guide 120 can include one, two, or essentially any number of spring assemblies to suit a particular application. The balance tubes 112, 113 with the spring mechanisms 114 disposed at least partially therein may be attached to a single balance guide 120 or multiple balance guides.

FIGS. 16-19 depict various views of the sash clip 130. The sash clip 130 is attached to a window sash and is configured to engage securely the balance guide 120. The sash clip 130 may be made of plastic, steel or composite. The sash clip 130 may be a unitary, substantially rigid structure. The sash clip 130 includes a base surface 134 and two arms 136 extending therefrom. The base surface 134 is generally planar. The base surface 134 may also include open or closed apertures 190 on the lateral sides and/or bottom side of the base surface 134 or within the body of the base surface 134. The apertures 190 allow for attachment of the sash clip 130 to a window sash. Various attachment means are contemplated. For example, screws 132 may be used to attach the sash clip 130 to the window sash through the apertures 190 disposed on the sides of the base surface 134. In an alternative embodiment, the base surface 134 forms a substantially rectangular shape with the apertures 190 formed on at least one side.

Figure 16:
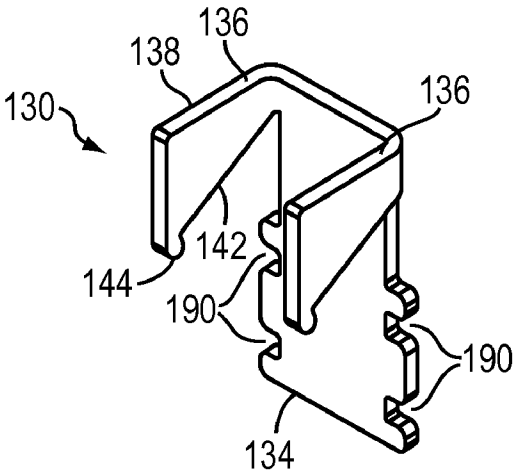
FIG. 16 is a schematic perspective view of a sash clip in accordance with one embodiment of the invention.
Figure 17:
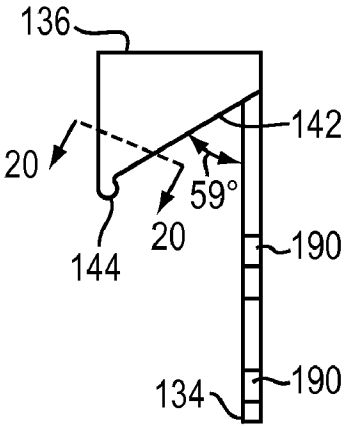
FIG. 17 is a schematic side view of the sash clip of FIG. 16.
Figure 19:
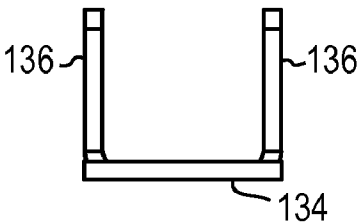
FIG. 19 is a schematic top view of the sash clip of FIG. 16.

As shown in FIGS. 16, 17, and 19, the two arms 136 extend from the base surface 134 and each has a top surface 138 and a bottom surface 140. The top surface 138 may be formed substantially perpendicular to the base surface 134, i.e., generally U-shaped in cross-section. The bottom surface 140 (i.e., the mating guide surface of the sash clip 130) at least partially forms a slope 142 with a protrusion 144 (i.e., the retention element of the sash clip 130) at a distal end of the slope 142. The slope 142 may be formed at an angle of about parallel to about perpendicular to the base surface 134. For example, the slope 142 may be formed at an angle of about 30 degrees to about 75 degrees with respect to the base surface 134. In one embodiment, the slope 142 is formed at an angle of about 60 degrees away from the base surface 134. Alternatively, the slope 142 may be formed at an angle substantially identical to the angle of the decline 150 of the balance guide 120. As previously described, the arms 136 form the mating guide surfaces 140 and retention elements 144 of the sash clip 130 and are configured to engage the mating guide surfaces and retention elements of the balance guide 120.

Figure 20:
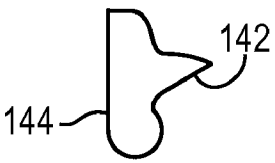
FIG. 20 is an enlarged portion of the arm of the sash clip of FIG. 16.
Figure 18:
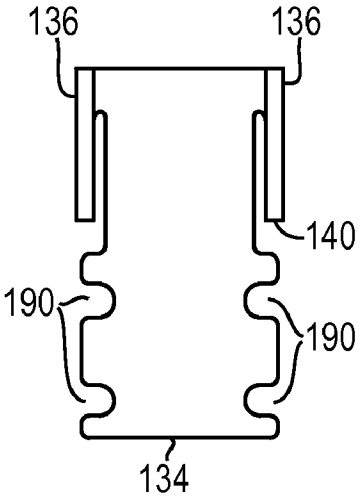
FIG. 18 is a schematic front view of the sash clip of FIG. 16.

FIG. 20 depicts a partial, enlarged view of a portion of one arm 136 of the sash clip 130. The protrusion 144 may have any polygonal or arcuate shape. For example, the protrusion 144 may be circular or oblong. The protrusion 144 corresponds in shape and mates with the retention elements 152 of the balance guide 120. Accordingly, the retention elements 152 of the balance guide may also have any polygonal or arcuate shape.

In one embodiment, the sash clip 130 is formed from one material and the two arms 136 are integrally formed with the base surface 134. Further, each of the protrusions 144 can be integrally formed with each of the two arms 136. In an alternative embodiment, the protrusions 144, the two arms 136, and the base surface 134 are separate components that are affixed together. For example, these components may be affixed through various means, such as by welding, epoxy, etc.

Referring back, FIG. 2, depicts an engagement of the balance guide 120 engaged with the sash clip 130. The sash clip 130 may be attached to a lower rail 104 or a vertical stile 105 of the window sash 102 through various means, including, for example, using mechanical fasteners 132, welding, and/or applying epoxy. In an alternative embodiment, the sash clip 130 is integrally formed with the lower rail 104 or the vertical stile 105 or attached to another element of the sash 102. The mating guide surfaces 150, 157, 158 and retention elements 152 of the balance guide 120 and the mating guide surfaces 142 and retention elements 144 of the sash clip facilitate alignment and engagement of the sash clip 130 with the balance guide 120. In this manner, the sash clip 130 engages the balance guide 120 via snap-fitting to secure the sash to the side-load window balance system. When engaged, the balance guide 120 receives the sash clip 130 in a fixed position relative to the balance guide 120 and maintains the registration and engagement of the guide 120 and clip 130 during operation of the sash 102. The balance guide 120 and clip 130 react torque applied by the balance spring mechanism 114 to the sash and does not require containment ribs or tracks forward in the jamb channel 110. Further, when the sash clip 130 engages the balance guide 120, the sash clip 130 is open to allow side shift clearance when installing and removing the window sash 102. As shown, the sash clip mating guide surfaces are sloped downward and include the sash clip retention elements extending downwardly therefrom. The sash clip retention elements 144 may be any geometrical structure, for example, a bulbous projection, an oblong shape, a spiked projection, a rectangle, a square, or any other shape.

Also shown in FIG. 2 is the spring mechanism 114. The balance guide 120 is directly and pivotably coupled to or attached to the spring mechanism 114. The balance guide 120 can be directly attached to the spring mechanism 114 within an internal cavity portion of the balance guide 120. In this manner, the balance guide 120 at least partially encompasses and overlaps the spring mechanism 114, such that the balance guide 120 is aligned generally horizontally to a lower end of the spring mechanism 114. The balance guide 120 may also partially encompass and overlap a portion of the balance tube 112, when the sash 102 is raised and the spring mechanism 114 is fully retracted into the balance tube 112.

The side-load balance system as shown in FIG. 2 does not require large, multi-component parts. The side-load balance system only requires a balance guide 120, a balance tube 112, a spring mechanism 114, and a sash clip 130, thereby minimizing the number of necessary components, which reduces the manufacturing costs and increases the stability of the balance system. Also, some components, including the balance guide 120 and sash clip 130 may each be integrally formed, further reducing manufacturing costs and the number of moving parts or interactions necessary between components, which increases the stability of the balance system. Further, because the balance guide 120 is directly and rigidly attached to the spring mechanism 114, the balance system is reliably secured for large window sashes, in distinct contrast to existing systems in which the counterbalance shoes are indirectly attached to the spring mechanism, where certain instances of jostling movements may disengage the counterbalance shoe from the spring mechanism. In addition, the balance guide 120 and the sash clip 130 can be smaller in size, e.g., height and depth, than current balance systems. Moreover, because the balance guide 120 partially encompasses and overlaps a portion of the spring mechanism 114, the contact point of the balance guide 120 and the sash clip 130 can be lower on the sash 102. Accordingly, a longer spring mechanism 114 with a greater spring force can be used. This can afford increased force for balancing heavier sash at any vertical position, as well as an increased amount of sash travel and better egress resulting from the larger window opening. Also, the balance system described herein is less dependent on the depth of the jamb channel and can, accordingly, fit into a variety of window geometries or for a variety of applications that afford more glass width and less stile and jamb width.

Figure 21:
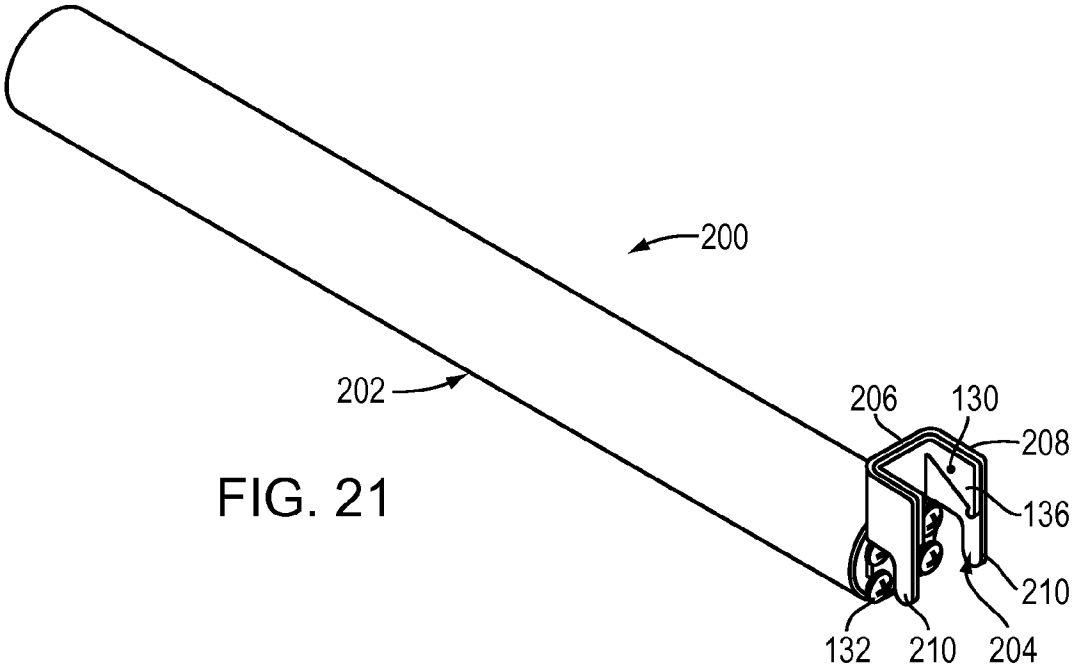
FIG. 21 is a schematic perspective view of an extender tool assembly in accordance with one embodiment of the invention.
Figure 22:
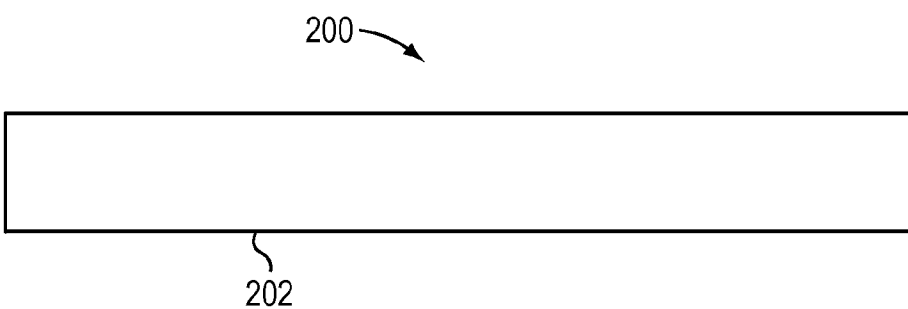
FIG. 22 is a schematic side view of the extender tool assembly of FIG. 21.
Figure 23:
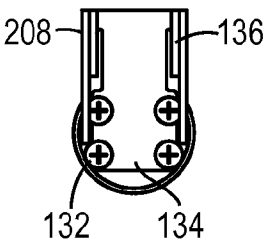
FIG. 23 is a schematic front view of the extender tool assembly of FIG. 21.

FIGS. 21-23 depict various views of an extender tool assembly 200 to facilitate installing a side-load window balance system in accordance with the invention. The tool 200 includes an extender bar 202, or handle, with a sash clip 130, such as the one shown in FIG. 16, secured at a distal end thereof. The extender bar 202 may be formed of various shapes, for example, cylindrical, rectangular, or other geometric shapes. The sash clip 130 is attached to the extender bar 202 via screws 132. Other attachment means are contemplated, as discussed above. A guide shield 204, which may be made of plastic, steel, or composite, is disposed between the sash clip 130 and the extender bar 202. Optionally, the guide shield 204 can be used with the sash clips 130 mounted to the sash. In this manner, the guide shield 204 may also be attached to the sash clip 130 and the extender bar 202 via the same means as the sash clip 130 is attached to the extender bar 202. The guide shield 204 includes a base 206, which is generally planar, with two extensions 208 extending from the base 206. The extensions 208 include a top surface and a bottom surface. The top surface can be perpendicular to the base 206. The bottom surface of the extensions of the guide shield 204 may also include optional downward projections 210, which may be parallel to the base 206, at a distal end of the extensions 208. The downward projections 210 may project as far down as the bottom of the base surface 134 of the sash clip 130. In this manner, the guide shield 204 forms a substantially U-shaped configuration, such that the guide shield 204 may fit, cover, and contact the two opposing sides 126 of the balance guide 120 when the sash clip 130 engages the balance guide 120. The extensions 208 of the guide shield 204 substantially encompass and extend beyond the arms 136 of the sash clip 130. The width of the extensions 208 of the guide shield 204 may generally correspond to the width of the jamb channel 110. In this manner, the guide shield 204 aligns and centers the sash clip 130, so that it will engage the balance guide 120 in a secure fashion, for example, by minimizing play between the components and possible rotation, such as roll or yaw, of the guide shield 204 and the sash clip 130 within the jamb channel 110. Further, the extensions 208 of the guide shield 204 also center and prevent the sash clip 130 from side-to-side slip or movement of the two arms 136 of the sash clip 130 when they are engaged with the balance guide 120. The guide shield 204 may be formed from one piece of material, with the downward projections 210 and the extensions 208 integrally formed with the base 206. Alternatively, the downward projections 210, the extensions 208, and the base 206 can be separate components that are affixed together via various means, for example, welding or epoxy.

Using the extender tool assembly 200 allows for a controlled extension of the balance guide 120, along with the ability of the user to use one hand to hold and control the extender tool assembly 200 and the other hand to pivot the jamb hook 160 into the locked position.

Figure 24:
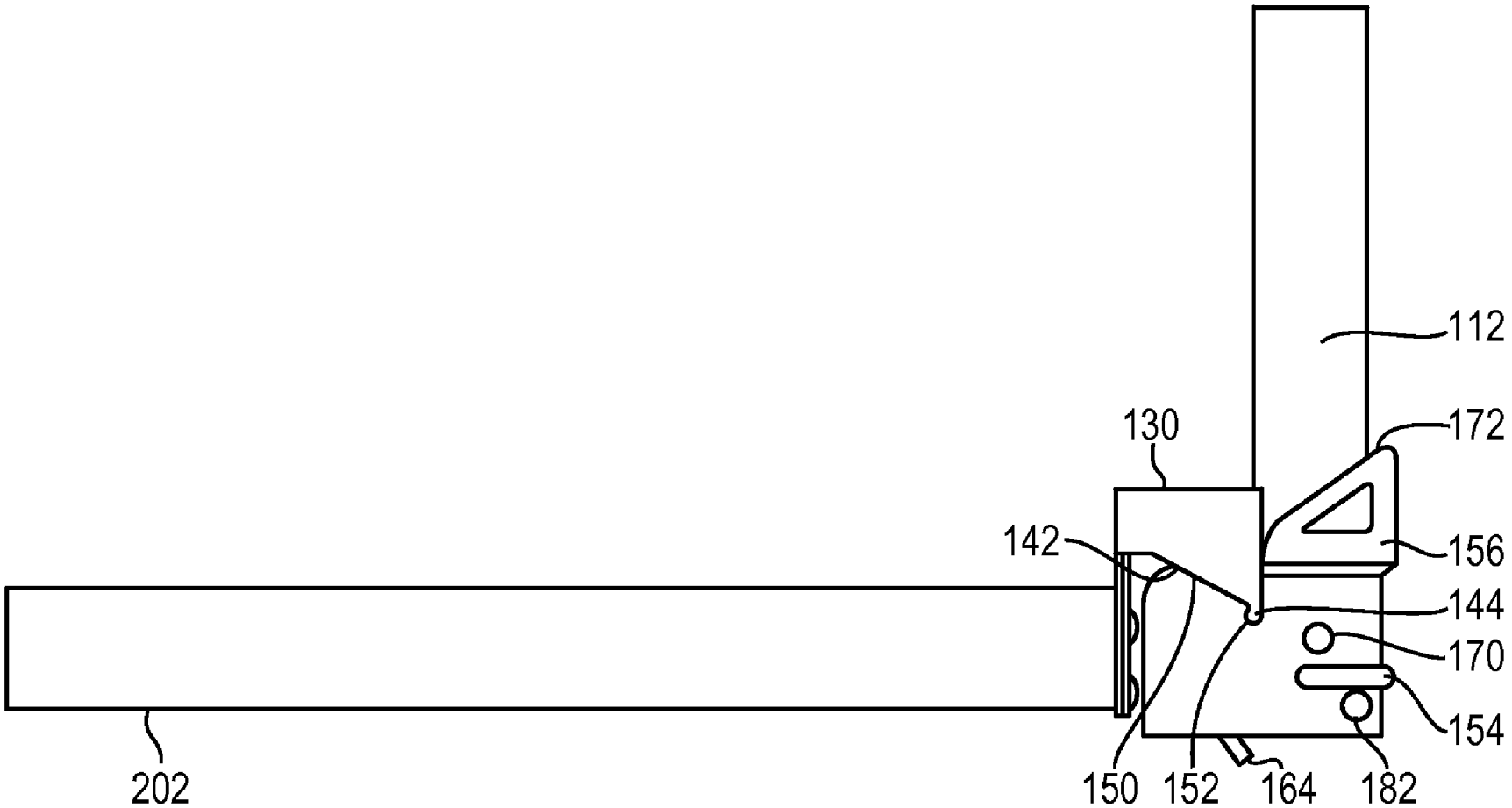
FIG. 24 is a schematic side view of an extender tool assembly, a window balance, and a balance guide in accordance with one embodiment of the invention.

FIG. 24 depicts an extender tool assembly 200 (depicted without the guide shield for clarity) with the sash clip 130 engaged with the balance guide 120. The length and shape of the bar 202 allows a user to grip the extender bar 202 and to provide leverage to guide the extender tool assembly 200 in the jamb channel 110 until the sash clip 130 is received by the balance guide 120 into a fixed position relative to the balance guide 120. The sash clip 130 engages the balance guide 120 in the manner described herein with respect to FIG. 2.

The extender tool assembly 200 is used to install the side-load window balance system. First, a top end of the balance tube 112 is mounted to a window jamb inside the jamb channel 110 via the mounting means 115 shown in FIG. 13. The bottom end of the balance tube 112 and an exposed portion of the spring mechanism 114 is unattached. The projections 154, 156 on the sides 126 of the balance guide 120 maintain and center the balance guide 120 within the window jamb or jamb channel 110 by minimizing sway and possible rotation thereof. A user may place the guide shield 204 and sash clip 130 of the extender tool assembly 200 in the jamb channel above the balance guide 120. The user guides the extender tool assembly 200 downward in the jamb channel until the sash clip 130 engages the balance guide 120. As described above, the width of the guide shield 204 centers and aligns the sash clip 130 on to the balance guide 120. Moreover, the mating guide surfaces 150, 157, 158 of the balance guide 120 align and guide the sash clip 130 into engagement with the balance guide 120. For example, if the sash clip 130 is first located to the fore of the recesses 152, the retention elements 144 on the bottom surfaces 140 of the arms 136 of the sash clip 130 are guided into the recesses 152 by the decline 150 of the top surface 122 of the balance guide 120 until the retention elements 144 engage the recesses 152 of the balance guide 120 forming a snap-fit engagement. If the sash clip 130 is first located to the rear of the recesses 152, the downward slope 172 of the second top surface of the balance guide 120 guides the retention element 144 to the recesses 152 until the retention elements 144 engage the recesses 152 of the balance guide 120, again forming a snap-fit engagement. Furthermore, the projections 154, 156 on the sides 126 of the balance guide 120 also allow the sash clip 130 to align and mate with the balance guide 120. The projections 154, 156 guide and center the guide shield 204, via the extensions 208 and downward projections 210 of the guide shield 204, so that the retention elements 144 of the sash clip 130 align with and engage the recesses 152 of the balance guide 120. Moreover, the extensions 208 and downward projections 210 of the guide shield 204 contact the two opposing sides 126 of the balance guide 120 and assist in preventing the sash clip 130 from slipping and moving from side-to-side relative to the balance guide 120. The various mating surfaces and the length of the extender bar 202 provide leverage for the user to pull the balance guide 120 downward and, therefore, extend the spring mechanism 114. For example, when the spring mechanism 114 is a combination of a torsion spring and an extension spring, the projections 154, 156 on the opposing sides 126 of the balance guide 120 center and align the balance guide 120 within the window jamb or jamb channel 110, even though the torsion spring may be inclined to rotate the balance guide 120 when the spring mechanism 114 is extended. The user may lower the balance guide 120 and extend the spring mechanism 114 to a desired height, for example, a height where the jamb hook 160, disposed in or near the bottom of the balance guide 120, can engage the jamb channel 110. For example, the angled hook 164 of the jamb hook 160 may engage a recess, opening, or aperture in the jamb channel 110 easily fabricated by punching or drilling a hole in the jam channel 110. This arrangement is in distinct contrast to current counterbalance solutions in which the counterbalance shoe must engage a jamb lance at predetermined heights. Accordingly, when the balance guide 120 is lowered to a desired height in the jamb channel 110, as determined by the user, the user can pivot the jamb hook 160 from the unlocked position to a locked position, in which the jamb hook 160 engages the jamb channel 110, for example, by placing the angled hook 164 into an opening in the jamb channel 110. Once the angled hook 164 engages the jamb channel 110, the extender tool assembly 200 can be easily disengaged from the balance guide 120 and a similar method employed to install the matching balance. A window sash can then be installed by placing the sash in the frame and lowering the sash clips into engagement with the balance guides.

Figure 25C:
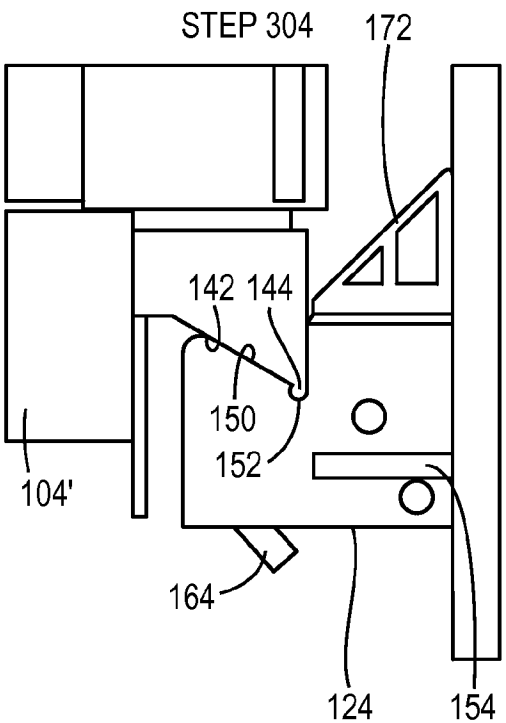
FIGS. 25A-25C depict a procedure for engaging a sash clip with a window balance and a balance guide in accordance with one embodiment of the invention.
Figure 25B:
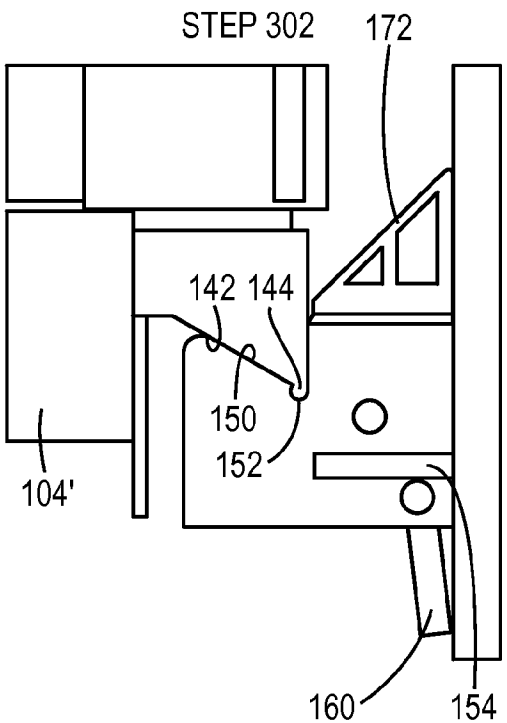
Figure 25A:
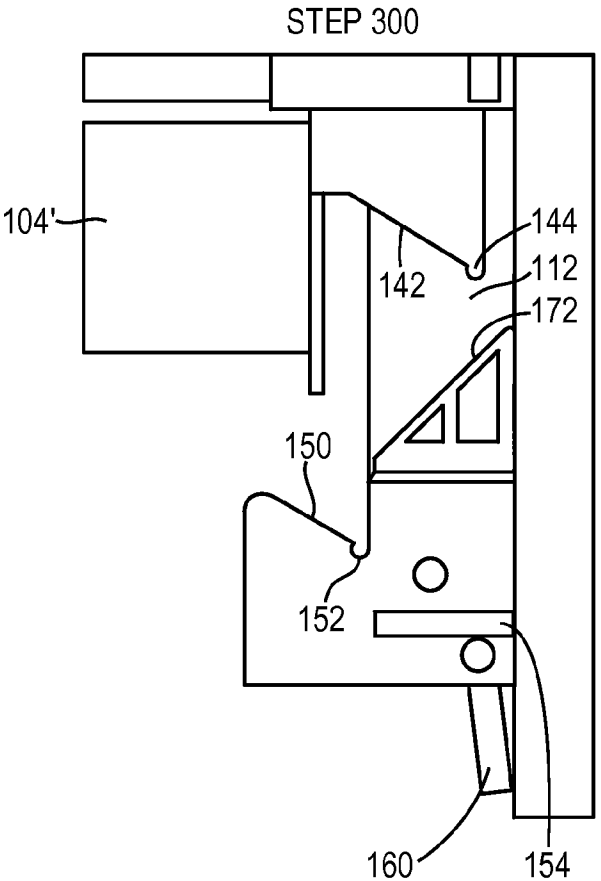

FIGS. 25A-25C depict a procedure for mounting a window sash to a side-load window balance after the extender tool assembly 200 positions the balance guide 120 in the jamb channel. A lower portion of the sash has been cut away for clarity. When installed, the lower rail of the sash is essentially aligned with the bottom surface 124 of the balance guide 120. In step 300, one end of the balance tube 112 has been attached to a window frame or jamb channel 110 and the jamb hook 160 of the balance guide 120 is engaged with the jamb channel 110. A sash clip 130 is attached to a lower rail 104'. Similar to described above, the sash 102 is inserted into the window frame and the sash clip 130 is lowered onto the balance guide 120. The mating guide surfaces 150, 157, 158 of the balance guide 120 align, center, and guide the sash clip 130 into its secured position.

FIG. 25B depicts the sash clip 130 centered and attached to the balance guide 120, in step 302. Once the sash clip 130 is attached to the balance guide 120, in step 304 of FIG. 25C, the sash 102 is lowered further, extending the balance. The jamb hook 160 can then be disengaged from the jamb channel 110 and pivoted back to the unlocked or stored position in which the jamb hook 160 is substantially disposed within an interior cavity of the bottom surface 140 of the balance guide 120. In this manner, the sash 102 is centered and fully supported by the balance to move in combination.

When the jamb hook 160 is removed from the jamb channel and substantially disposed within the balance guide 120, the adjustment element (see FIG. 13) of the spring mechanism 114 is exposed through the bottom of the balance guide 120, such that a user can access and operate the adjustment mechanism. Moreover, even when the jamb hook 160 is engaged to the jamb channel, the configuration of the jamb hook 160 allows access to the adjustment element of the spring mechanism 114 through the bottom of the balance guide 120, such that a user can access and adjust the adjustment mechanism, as described above. In both manners, the spring mechanism 114 is adjustable or can be manipulated while installed in the jamb channel, without removing the balance system or the sash, in distinct contrast to current solutions.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A side-load window balance system comprising:

a spring assembly;

a balance guide connected to the spring assembly; and a sash clip adapted to mate with the balance guide, wherein the sash clip and balance guide comprise mating guide surfaces and retention elements to align and engage the sash clip with the balance guide so that the sash clip is received in a fixed position relative to the balance guide when installed, wherein the balance guide forms a generally U-shaped interior and comprises a top surface defining a generally V-shaped configuration forming the mating guide surface with the retention elements of the balance guide located at a vertex of the generally V-shaped configuration to guide into alignment the retention elements to engage the sash clip with the balance guide, a front surface, and two opposing side surfaces.

2. The side-load window balance system of claim 1, wherein the spring assembly is selected from the group consisting of a torsion spring, an extension spring, a block and tackle arrangement, a constant force balance, or any combination thereof.

3. The side-load window balance system of claim 1, wherein the balance guide is pivotably and directly attached about a lower end of the spring assembly.

4. The side-load window balance system of claim 1, wherein the retention elements of the balance guide releasably receive the retention elements of the sash clip.

5. The side-load window balance system of claim 1, wherein the retention elements of the balance guide are disposed adjacent the two opposing sides.

6. The side-load window balance system of claim 1, wherein each of the two opposing side surfaces includes at least two lateral projections for engaging a window jamb and centering the balance guide in the window jamb.

7. The side-load window balance system of claim 1, wherein the retention elements of the sash clip and the balance guide form a snap-fit engagement therebetween.

8. The side-load window balance system of claim 1, wherein the sash clip is aligned generally horizontally to a lower end of the spring assembly when in the fixed position.

9. The side-load window balance system of claim 1, wherein the sash clip comprises a unitary, substantially rigid structure forming a base surface with two arms extending from the base surface.

10. The side-load window balance system of claim 9, wherein the base surface comprises means for attaching the sash clip to a window sash.

11. The side-load window balance system of claim 9, wherein the arms form a top surface and a bottom surface, the bottom surface of each of the two arms forming the mating guide surface of the sash clip.

12. The side-load window balance system of claim 9, wherein the retention elements of the sash clip comprise a protrusion at a distal end of each of the two arms.

13. The side-load window balance system of claim 1 further comprising a jamb hook pivotably attached within an interior of a bottom of the balance guide, wherein the jamb hook comprises a lever arm and an angled hook at a distal end.

14. The side-load window balance system of claim 13, wherein the lever arm has a generally U-shaped configuration.

15. The side-load window balance system of claim 13, wherein the jamb hook is pivotable about an axis between a locked position and an unlocked position, the angled hook engageable with a recess of a window jamb when in the locked position and the jamb hook substantially disposed and releasably affixed within the interior of the balance guide when in the unlocked position.

16. The side-load window balance system of claim 15, wherein a surface of the interior of the balance guide includes a projection for securing the jamb hook at least partially within the interior of the balance guide.

17. The side-load window balance system of claim 1 further comprising an adjustable element coupled to a lower end of the spring assembly to adjust spring force of the balance system.

18. The side-load window balance system of claim 17, wherein the adjustable element is exposed and accessible through the balance guide.

19. The side-load window balance system of claim 1, wherein the spring assembly comprises a pair of springs.

20. A balance guide for a side-load window balance system comprising:

a generally U-shaped structure having a top surface, a front surface, and two opposing side surfaces, the top surface defining a generally V-shaped configuration with at least one retention element located at a vertex of the generally V-shaped configuration to guide into alignment corresponding retention elements of a sash clip to secure the sash clip with the balance guide.

21. A sash clip for a side-load window balance system comprising:

a unitary, substantially rigid structure comprising:

a base surface; and two arms extending from the base surface, each arm having a top surface and a bottom surface, the bottom surface comprising an angled surface and a protrusion at a distal end of the angled surface configured for mating with a balance guide defining a generally V-shaped configuration.

* * * * *